US010071500B2

(12) United States Patent
George

(10) Patent No.: US 10,071,500 B2
(45) Date of Patent: Sep. 11, 2018

(54) SAFETY SYSTEM FOR A CHAINSAW

(71) Applicant: Rex George, San Jose, CA (US)

(72) Inventor: Rex George, San Jose, CA (US)

( * ) Notice: Subject to any disclaimer, the term of this patent is extended or adjusted under 35 U.S.C. 154(b) by 619 days.

(21) Appl. No.: 14/272,348

(22) Filed: May 7, 2014

(65) Prior Publication Data

US 2014/0245872 A1 Sep. 4, 2014

Related U.S. Application Data

(63) Continuation of application No. 12/420,728, filed on Apr. 8, 2009, now Pat. No. 8,752,301.

(51) Int. Cl.

*B27B 17/00* (2006.01)
*B27B 17/08* (2006.01)
*B27G 19/00* (2006.01)

(52) U.S. Cl.

CPC ..... *B27B 17/00* (2013.01); *B27B 17/083* (2013.01); *B27G 19/003* (2013.01); *Y10T 83/089* (2015.04)

(58) Field of Classification Search

CPC ..... B27G 19/003; B27B 17/00
USPC ..... 144/154.5, 356, 384, 391, 427, 286.5; 29/708, 254, 413; 324/550, 424; 408/5; 56/10.9, 11.3; 192/192 A, 129 R, 130; 102/202.7; 89/1.56; 137/68.12, 72, 76; 188/5, 6, 110, 189; 169/57, 59, 42, 169/DIG. 3; 74/2; 403/2, 28; 411/2, 39, 411/390; 335/1, 242, 132; 318/362; 241/32.5; 337/239, 148, 1, 5, 10, 17, 337/140, 170, 190, 237, 401, 290, 404, 337/405; 218/2, 154; 307/639, 328, 115, 307/326, 142, 117, 126, 131; 451/409; 280/806; 297/480; 187/69, 77, 89, 189, 187/216, 166, 72.3; 340/679, 680, 686.1, 340/687, 686.3, 686.6; 30/381–387; 83/DIG. 1, 58, 62, 62.1, 63, 72, 76.7, 83/788, 581, 471.2, 477.1, 477.2, 522.12, 83/526, 397.1

See application file for complete search history.

(56) References Cited

U.S. PATENT DOCUMENTS

| | | | | |
|---|---|---|---|---|
| 3,785,230 | A | 1/1974 | Lokey | |
| 3,785,465 | A | 1/1974 | Johansson | |
| 3,923,126 | A | 12/1975 | Bidanset | |
| 3,953,770 | A | 4/1976 | Hayashi | |
| 4,020,488 | A | 4/1977 | Martin et al. | |
| 4,117,752 | A | 10/1978 | Yoneda | |
| 4,152,833 | A | 5/1979 | Phillips | |
| 4,528,538 | A | 7/1985 | Andersen | |
| 4,553,326 | A | 11/1985 | West | |
| 4,677,718 | A | 7/1987 | Babel | |
| 5,081,406 | A | 1/1992 | Hughes et al. | |
| 5,125,160 | A | 6/1992 | Gassen | |
| 5,138,550 | A * | 8/1992 | Abraham | A63K 3/00 119/702 |

(Continued)

FOREIGN PATENT DOCUMENTS

| | | |
|---|---|---|
| JP | 63148133 | 6/1988 |
| WO | 0126064 | 4/2001 |

*Primary Examiner* — Jason Daniel Prone
(74) *Attorney, Agent, or Firm* — Sheppard, Mullin, Richter & Hampton LLP

(57) ABSTRACT

Systems and methods for a chainsaw safety device are described. In some embodiments, a method comprises activating a chainsaw, receiving a first acceleration value associated with acceleration of the chainsaw, comparing the first acceleration value to a predetermined acceleration threshold, and deactivating the chainsaw based on the comparison.

9 Claims, 6 Drawing Sheets

(56) References Cited

U.S. PATENT DOCUMENTS 5,481,139 A 1/1996 Lucas
5,942,975 A 8/1999 Sorensen
5,984,020 A 11/1999 Meyer et al.
6,157,096 A 12/2000 Vinciguerra
6,330,848 B1 12/2001 Nishio et al.
6,366,099 B1 4/2002 Reddi
6,711,590 B1 * 3/2004 Lennon ..... G06F 17/3079 707/E17.028
6,812,416 B2 11/2004 Tasse
6,922,153 B2 7/2005 Pierga et al.
6,945,149 B2 9/2005 Gass et al.
7,000,514 B2 2/2006 Gass et al.
7,129,430 B2 10/2006 Banghard et al.
7,373,863 B2 5/2008 O'Banion et al.
7,729,507 B1 * 6/2010 Malachowsky .... H04N 5/23248 348/208.1
7,827,889 B2 11/2010 Carrier
7,971,613 B2 7/2011 Gass et al.
8,090,073 B2 1/2012 Sugiyama et al.
8,103,387 B2 1/2012 Gothard
8,196,732 B2 6/2012 Fatula et al.
8,447,863 B1 * 5/2013 Francis, Jr. ..... G06F 17/30542 707/724
8,616,056 B2 * 12/2013 Sammoura ..... G01C 19/5698 73/504.13
8,752,301 B2 * 6/2014 George ..... B27B 17/083 30/381
8,984,136 B1 * 3/2015 Francis, Jr. ..... H04W 4/02 700/245
2004/0181951 A1 9/2004 Wittke
2009/0165615 A1 7/2009 Nishimiya et al.
2010/0064532 A1 3/2010 Wittke et al.
2012/0036725 A1 * 2/2012 Osborne ..... B27B 17/083 30/383

* cited by examiner

SAFETY SYSTEM FOR A CHAINSAW

CROSS REFERENCE TO RELATED APPLICATIONS

This application is a continuation of U.S. patent application Ser. No. 12/420,728, filed Apr. 8, 2009, entitled "Systems and Methods for a Chainsaw Safety Device," now U.S. Pat. No. 8,752,301, which is hereby incorporated by reference herein.

BACKGROUND

1. Field of the Invention

The present invention generally relates to safety devices. More particularly, the invention relates to systems and methods for a chainsaw safety device.

2. Description of Related Art

For decades, timber industry workers as well as everyday chainsaw operators have suffered horrific injuries and some times death due to chainsaw operation. In some examples, chainsaw injuries is caused by kickback of the chainsaw, lack of control of the chainsaw, or accidentally dropping an active (e.g., activated) chainsaw. Contact with a moving chain accounts for 85 percent of injuries to chainsaw operators.

Kickback of a chainsaw is when the teeth on the chain catch on material (e.g., wood or metal) as they rotate around the tip of the blade. The teeth may have enough force to cause the blade to kick back violently toward the chainsaw operator, hence the term "kickback." In some examples, kickback may occur when the nose of the blade of a chainsaw strikes another object such as a metal spike, starting a bore cut improperly, and when the blade nose or tip of the chainsaw catches the bottom or side of a saw cut during reinsertion.

Loss of control of the chainsaw may occur if the chainsaw operator is poorly trained or distracted. In one example, a chainsaw operator may saw through a log and be unprepared when the log is cut all the way through. Pressure on the chainsaw may cause the chainsaw to complete the cut and then torque towards an unprotected portion of the operator's body.

Dropping an active chainsaw may also lead to significant injury. These kinds of accidents may occur as the chainsaw is being used high up in a tree or by an operator who is not paying attention and the chainsaw slips through the operator's grip.

FIG. 1 is a chainsaw 100 in the prior art. The chainsaw 100 includes a blade 102, a guide bar 104 which guides the blade 102, a front handle 106, a starter handle 108, a throttle trigger lockout 110, a throttle trigger 112, and a chain brake lever 114.

When starting the chainsaw 100, a chainsaw operator may hold the front handle 106 of the chainsaw 100 and pull on the starter handle 108 to get the engine of the chainsaw 100 running Once active, the operator will depress the throttle trigger lockout 110 in order to pull the throttle trigger 112 which starts the chainsaw blade 102 to run around the guide bar 104. The speed of the blade 102 typically increases as the pressure on the throttle trigger 112 increases.

The chain brake lever 114 performs two functions including hand protection as well as a braking function. For example, when the chain brake lever 114 is pushed back, the chain brake lever 114 activates a chain brake which slows down the engine and eventually disengages the centrifugal clutch of the chainsaw. Unfortunately, if the chainsaw kicks back to the operator quickly, the chainsaw may cause significant injury before the blade 102 slows to a safe state. Further, the chain brake lever 114 does not protect the operator from injury when control of the chainsaw is lost when a cut is complete (e.g., the chainsaw 100 suddenly accelerates in a downward position after resistance of the cutting material is gone) or when an active chainsaw is dropped. The chain brake lever 114 will only activate if the top of the front handle 106 of the chainsaw 100 is held. If the side of the front handle 106 is held (which is the case when making non-vertical cuts) the chain brake lever 114 will not protect the operator from kickback because the operator's wrist cannot activate the chain brake on a kick back event.

Various companies and chainsaw manufactures have designed helmets, protective gloves, eye protection, hearing protection, and special clothing to reduce the risk of injury. However, not all chainsaw operators wear the protective helmets or clothing due to lack of training, heat, limitations of movement, or affordability of equipment. Although injury may be reduced when wearing the helmet and/or clothing, the rotating blade 102 of the chainsaw 100 may still cause significant injury before the blade 102 is deflected or slows.

A tip guard is also available to protect an operator against kickback. However, even if installed correctly, the use of the chainsaw may be limited by the tip guard. Further, the tip guard will not prevent injury due to dropping the chainsaw or lack of control of the chainsaw.

SUMMARY OF THE INVENTION

Systems and methods for a chainsaw safety device are described. In some embodiments, a method comprises activating a chainsaw, receiving a first acceleration value associated with acceleration of the chainsaw, comparing the first acceleration value to a predetermined acceleration threshold, and deactivating the chainsaw based on the comparison.

The first acceleration value may be associated with an acceleration of the chainsaw along the x axis. Further, the first acceleration value may be associated with an acceleration of the chainsaw along the y axis. The first acceleration value may be associated with an acceleration of the chainsaw along the z axis.

In some embodiments, the method may further comprise calculating an engine revolutions-per-minute (RPM) of the chainsaw based on a signal received from an ignition coil. Deactivating the chainsaw based on the comparison may comprise deactivating the chainsaw when the first acceleration value is greater than the predetermined acceleration threshold. Deactivating the chainsaw may occur by activating a kill switch of the chainsaw.

A microprocessor may perform the comparison. In some embodiments, comparing the acceleration value to the predetermined acceleration threshold comprises a comparator comparing the first acceleration value to the predetermined acceleration threshold which is set by a potentiometer.

In various embodiments, the predetermined threshold may be modified. The method may further comprise receiving a second acceleration value and determining a duration of acceleration of the chainsaw based on the first acceleration value and the second acceleration value. Deactivating the chainsaw based on the comparison may comprise deactivating the chainsaw based on a comparison of the duration to a predetermined duration threshold and comparing at least one acceleration value to the predetermined acceleration threshold.

Deactivating the chainsaw may comprise triggering a kill switch of the chainsaw based on the comparison. In some embodiments, the predetermined acceleration threshold takes into account engine vibration of the chainsaw.

In various embodiments, a chainsaw comprises an accelerometer, a comparison module, and a kill switch. The accelerometer may be configured to generate a first acceleration value based on an acceleration of the chainsaw. The comparison module may be configured to compare the first acceleration value to a first predetermined acceleration threshold and generate a risk signal based on the comparison. The kill switch may be configured to interrupt power to the chainsaw in response to the risk signal.

In some embodiments, a chainsaw comprises a means to determine an acceleration value, a means to compare the acceleration value to a predetermined acceleration value, and a means to generate a signal based on the comparison to interrupt the power to the chainsaw.

DETAILED DESCRIPTION OF THE INVENTION

Methods and systems of a safety device for operation of a chainsaw are disclosed. In various embodiments, an acceleration and duration of acceleration of an active chainsaw is detected. When the acceleration and duration of the acceleration is outside of predetermined thresholds, the chainsaw may be deemed to be in an unsafe condition and the power to the chainsaw (or the chainsaw blade) is cut or interrupted to deactivate the chainsaw.

In one example, a chainsaw operator uses a chainsaw to cut a tree. Due to unsafe use of the chainsaw or the chainsaw blade getting caught on metal on or around the tree, the chainsaw may kickback towards the operator. During kickback, a safety device within or attached to the chainsaw may detect the change in acceleration of the chainsaw as well as the (e.g., an accelerometer within the chainsaw detects the kickback of the chainsaw by detecting acceleration along the x axis for an unsafe duration of time). In response, the safety device may activate a kill switch to deactivate (e.g., shut down the engine of) the chainsaw, engage a chainsaw chain brake, and/or disengage a chainsaw clutch before the chainsaw injures the operator.

The safety device may be used to reduce or eliminate injury caused by unsafe conditions. In various embodiments, the safety device may detect acceleration of the chainsaw associated with dangerous conditions including, but not limited to, a kickback event, follow through, loss of balance, skate/bounce, lack of control, and when the chain hits a nail or an object which cannot be cut which may result in chain breakage. When acceleration associated with one or more of these conditions is detected, the safety device may respond to reduce or eliminate physical injury.

Figure 2A:
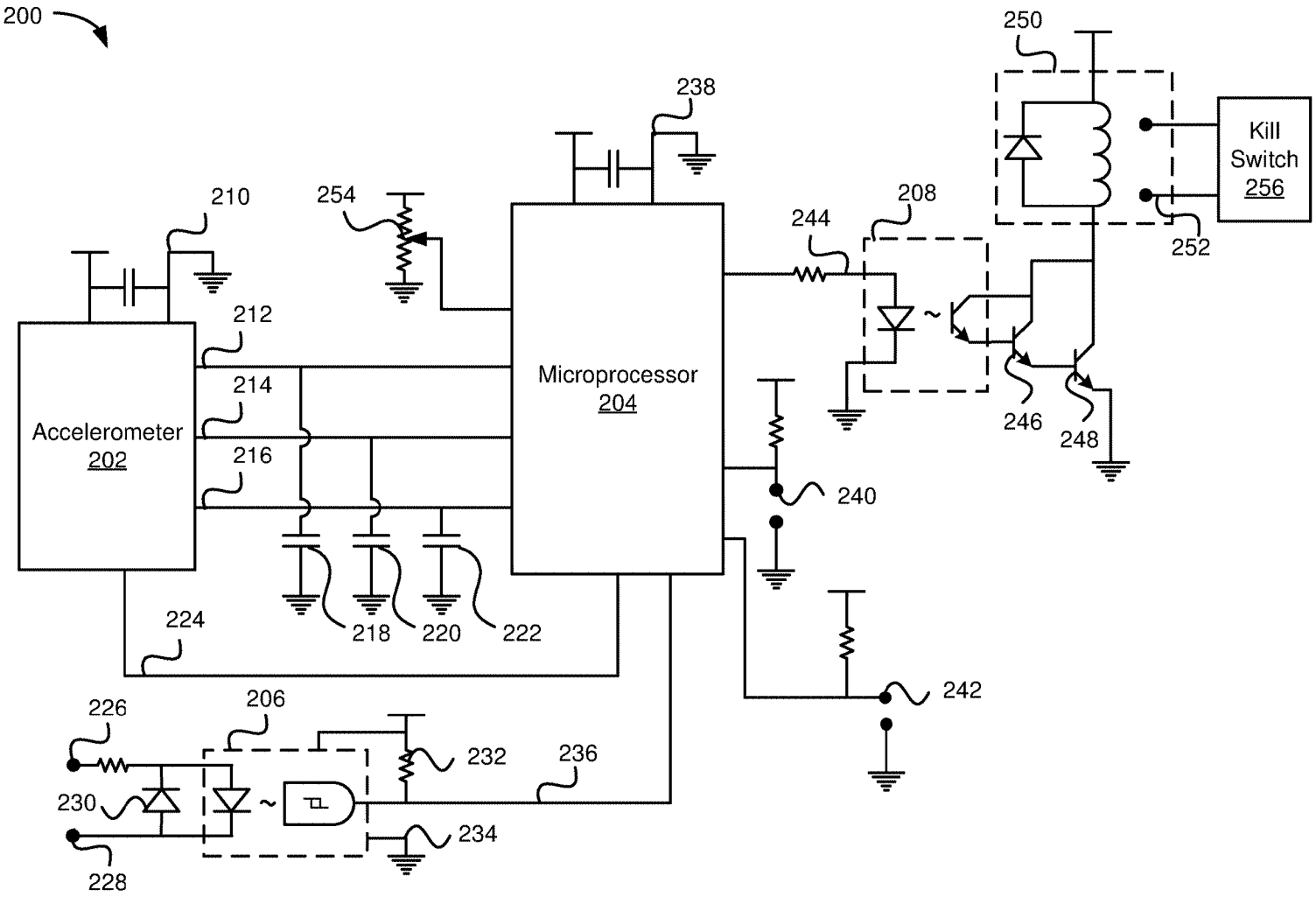
FIG. 2A and FIG. 2B show a safety device for a chainsaw with a microprocessor in some embodiments.
Figure 2B:
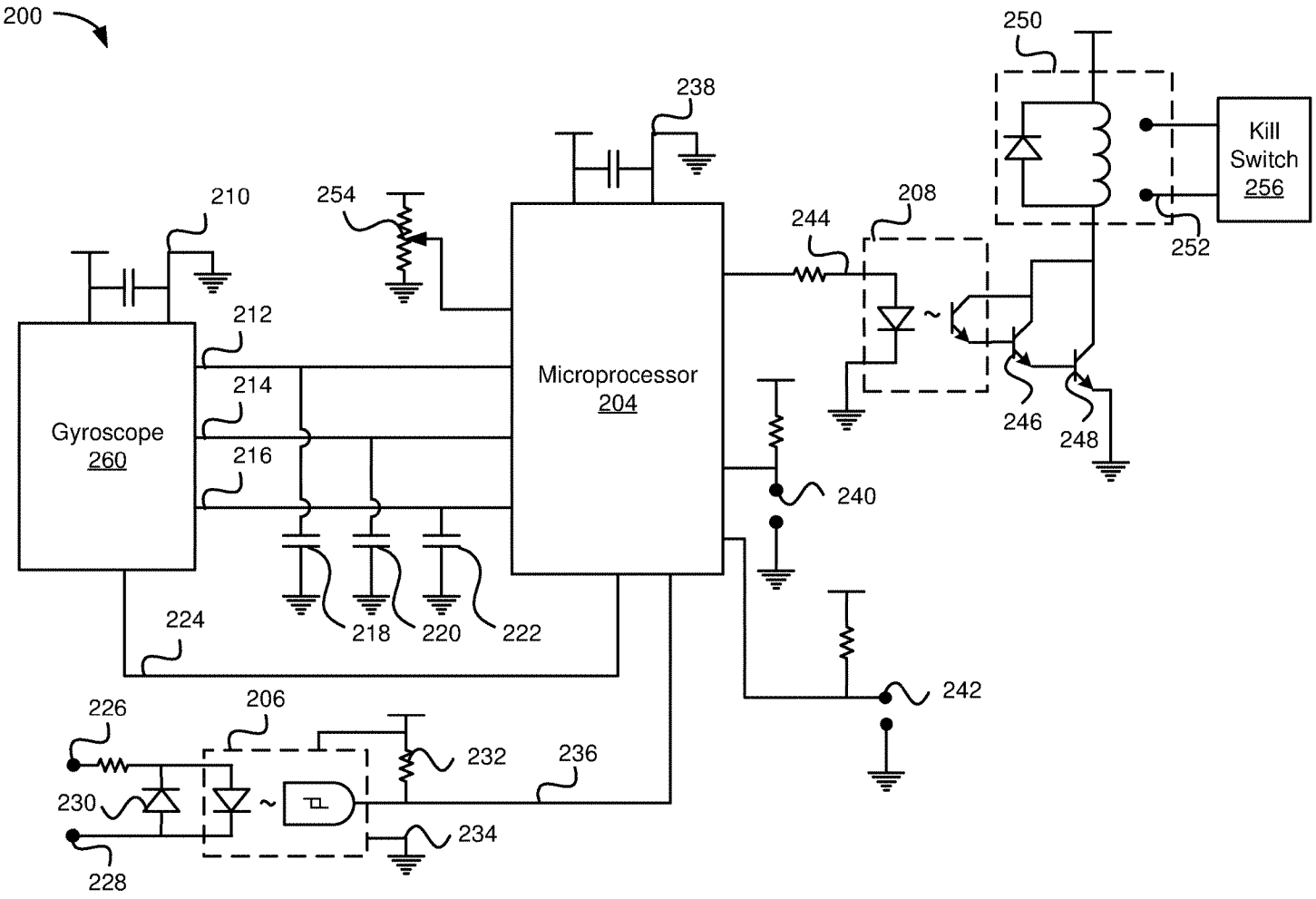

FIG. 2A and FIG. 2B show a safety device 200 for a chainsaw with a microprocessor 204 in some embodiments. In some embodiments, the safety device 200 may be coupled to the power of an existing chainsaw and a kill switch 256 or any device configured to deactivate or interrupt power to the chainsaw or the blade of the chainsaw. The safety device 200 comprises an accelerometer 202 (as shown in FIG. 2A) or a gyroscope 260 (as shown in FIG. 2B), the microprocessor 204, an optically coupled isolator 206, and an optically coupled isolator 208. The following description of FIG. 2A is also applicable to FIG. 2B with gyroscope 260 replacing accelerometer 202.

The accelerometer 202 may be any device configured to detect acceleration of the chainsaw along at least one axis. In one example, the accelerometer 202 may be a micro electro-mechanical systems (MEMS) accelerometer. The accelerometer 202 may be coupled to a ground 210 and a capacitor. The accelerometer 202 may also be coupled to the power source and the other side of the capacitor. These elements depend upon the type and/or model of accelerometer 202 within the safety device 200. The accelerometer 202 may be coupled to many different circuit elements.

In various embodiments, the accelerometer 202 determines at least one acceleration value associated with an acceleration of a chainsaw. The accelerometer 202 may determine an acceleration value of the x, y, and/or z axes of the chainsaw. The accelerometer 202 may also determine a separate gravity value associated with the effect on gravity on the chainsaw (e.g., a drop of the chainsaw).

In some embodiments, the accelerometer 202 determines acceleration values in the x, y, and z axes of the chainsaw. The accelerometer 202 may provide the acceleration value for the x axis over signal path 212 to the microprocessor 204. The accelerometer 202 may also provide the acceleration value for the y axes over signal path 214 as well as the acceleration value for the z axes over signal path 216 to the microprocessor 204.

In some embodiments, the acceleration value(s) provided by the accelerometer are converted from analog to digital signals by one or more digital to analog (ADC) converters. In one example, the acceleration value for the x axis 212 is provided by the accelerometer 202 as an analog signal. The ADC converts the analog signal into a digital signal which is then sampled by the microprocessor 204. In some embodiments, the safety device 200 does not comprise the ADC. In one example, the accelerometer 202 provides the acceleration value for the x axis 212 as a digital value. In another example, the microprocessor 204 is configured to receive analog values. There may be any ADC type or model configured to convert the analog acceleration value to a digital acceleration value.

The capacitors 218, 220, and 222 may be coupled to ground and the signal paths 212, 214, and 216, respectively. In some embodiments, the capacitors 218, 220, and 222 are a part of the ADC(s). In other embodiments, the capacitors 218, 220, and 222 are a part of a low pass filter that, when coupled with resistance along the respective signal path, may filter the respective acceleration value and remove acceleration values that fall below a predetermined duration based on capacitance of capacitors 218, 220, and/or 222.

The microprocessor 204 is any processor configured to receive the acceleration value for the x axis over signal path 212, an acceleration value for the y axis over signal path 214, and the acceleration value for the z axis over signal path 216. In one example, the microprocessor 204 samples the acceleration value for the x axis over signal path 212, the acceleration value for the y axis over signal path 214, and the acceleration value for the z axis over signal path 216.

In some embodiments, the accelerometer 202 also provides a separate duration value associated with each acceleration value. In other embodiments, the microprocessor 204 determines the duration of acceleration of the chainsaw in an axis based on sampling and/or receiving the acceleration value from the accelerometer 202.

The microprocessor 204 may be configured by software to determine when acceleration of the chainsaw for a set duration is unsafe. In various embodiments, the microprocessor 204 is programmed to compare one or more acceleration values in one or more axes to a predetermined threshold value. In one example, during kickback, the chainsaw may accelerate along the x axis of the chainsaw. The accelerometer 202 provides one or more acceleration values associated with the kickback acceleration along the x axis to the microprocessor 204. The microprocessor 204 may determine a duration of the acceleration based on the acceleration value(s) received from the accelerometer 202. The microprocessor 204 may then compare the acceleration values at the duration to the predetermined threshold values. Based on the comparison, the microprocessor may provide an alert signal (e.g., a risk signal) to the optically coupled isolator 208.

The microprocessor 204 may also determine a gravity value. In various embodiments, when the acceleration value(s) of the chainsaw fall to zero (0) (e.g., the acceleration values along the x axis, y axis, and z axis are zero), then the chainsaw may have been dropped. The microprocessor 204 may be configured to sense that condition and provide the risk signal to the optically coupled isolator 208. In some embodiments, the sensitivity to gravity (i.e., the g level) of the microprocessor 204 may be controlled by modifying a g adjust potentiometer 254. For example, the microprocessor 204 may determine that a dangerous condition exists and provide the risk signal to the optically coupled isolator 208 when the acceleration values along the x axis, y axis, and/or the z axis are at or near zero.

In other embodiments, the accelerometer 202 detects the effect of gravity on the chainsaw and may detect if the chainsaw has been dropped. In one example, the accelerometer 202 may provide a signal to the microprocessor 204 that a dangerous state exists based on the gravity determination of the accelerometer 202. The microprocessor 204 may then provide the risk signal to the optically coupled isolator 208.

Jumper 240 and jumper 242 are optional. In some embodiments, jumper 240 may be enabled by installing a jumper. Enabling jumper 240 may select the x axis. As a result, the microprocessor 204 may compare an acceleration value for the x axis to threshold acceleration values. In various embodiments, enabling jumper 242 may select the y axis. In one example, if both jumper 240 and jumper 242 are enabled, the microprocessor 204 may compare acceleration value for the x, y, and z. There may be any number of jumpers to select or deselect any number of axes or any number of combinations of axes.

The microprocessor 204 may be coupled to a ground 238 that is coupled to a power source over a capacitor. The microprocessor 204 may also be coupled to the power source and the other side of the capacitor. These elements depend upon the type and/or model of microprocessor 204 within the safety device 200. The microprocessor 204 may be coupled to many different circuit elements.

The microprocessor 204 may be optionally coupled to the accelerometer 202 to receive a self test signal over signal path 224. In various embodiments, the accelerometer 202 and/or the microprocessor 204 may be tested with the self test signal.

In various embodiments, the microprocessor 204 receives power and/or information regarding the engine of the chainsaw. In one example, inputs 226 and 228 are coupled to the ignition coil of the chainsaw. A coil signal may be received by photodetector 230 which is in parallel to the optically coupled isolator 206. The optically coupled isolator 206 is coupled to a resistor 232 and a ground 234, and may act as a zero crossing detector to generate pulses based on the input from the ignition coil. The pulses may be provided to the microprocessor 204 over signal path 236. The microprocessor 204 may calculate the revolutions per minute (RPM) of the engine of the chainsaw. In some embodiments, the microprocessor 204 may activate the safety feature of the safety device 200 (e.g., activating the accelerometer 202 and/or comparing acceleration values at a duration to acceleration threshold values) once a predetermined RPM threshold is met.

In one example, the optically coupled isolator 206 may comprise an optoisolator which contains a gallium arsenide IRED optically coupled to a high-speed integrated detector with a Schmitt trigger output (e.g., part number H11L1). In some embodiments, the optically coupled isolator 208 may comprise an LED and a photodetector. In some examples, the optically coupled isolator 208 may comprise an optoisolator, optocoupler, photocoupler, or photoMOS). The photodetector may comprise a silicon diode, transistor Darlington pair, an optically triggered, space-charge region (SCR), photocell, triode for alternating current (TRIAC) or phototransistor. In various embodiments, the optically coupled isolator 208 is a device that uses a short optical transmission path to transfer a signal between elements of a circuit while keeping the elements electrically isolated. In one example, an electrical signal received by the optically coupled isolator 208 is transferred as an optical signal which generates another electrical signal.

In various embodiments, the optically coupled isolator 206 may provide electrical isolation, substantially fast response time, limited noise immunity, and digital logic compatibility. The optically coupled isolator 206 may comprise a 6-lead DIP type package or may comprise several components in communication that produces substantially similar output of the optically coupled isolator 206.

In some embodiments, a Schmitt trigger is incorporated within the optically coupled isolator 206. The Schmitt trigger incorporates feedback. In one example, when the input is higher than a certain chosen threshold, the output is high; when the input is below another lower chosen threshold, the output is low. When the input is between the two thresholds, the output of the Schmitt trigger may not change (i.e., the Schmitt trigger functions with at least some degree of hysteresis).

The input into the optically coupled isolator 206 may comprise voltage from the primary ignition coil of the chainsaw via inputs 226 and 228. In various embodiments, the LED (e.g., IRED) of the optically coupled isolator 206 may be in parallel with another LED in an opposite direction. The resister coupled to input 226 may represent input resistance.

Those skilled in the art will appreciate that the optically coupled isolator 206 is optional. In various embodiments, the safety features of the microprocessor 204 are always on or are otherwise active when the chainsaw is active. Further, it will be appreciated by those skilled in the art that the RPM of the engine of the chainsaw may be determined in many ways. In one example, the information may be received from any circuitry which may not be optical in nature or isolated.

In various embodiments, the optically coupled isolator 208 receives the alert (e.g., risk) signal from the microprocessor 204 over signal path 244. There may be a resistor or output resistance associated with the microprocessor 204 graphically represented in FIG. 2. The optically coupled isolator 208 provides the a signal to magnetic circuit breaker 250 comprising a photodetector in parallel with an inductor which is magnetically coupled to paths 252 which may be coupled to the kill switch or any device configured to interrupt the power to the chainsaw or blade of the chainsaw. In various embodiments, the base of the transistors 246 is coupled to the emitter of the optically coupled isolator 208 which produces a signal received by the base of the transistor 248. The emitter of the transistor 248 may be coupled to ground. In some embodiments, the signal that is caused by the magnetic breaker 250 is a risk signal.

The optically coupled isolator 250 may comprise an LED and a phototransistor. In one example, in response to an event signal from the microprocessor 204, the LED of the optically coupled isolator 208 emits light which is detected by the phototransistor of the optically coupled isolator 208.

Figure 4:
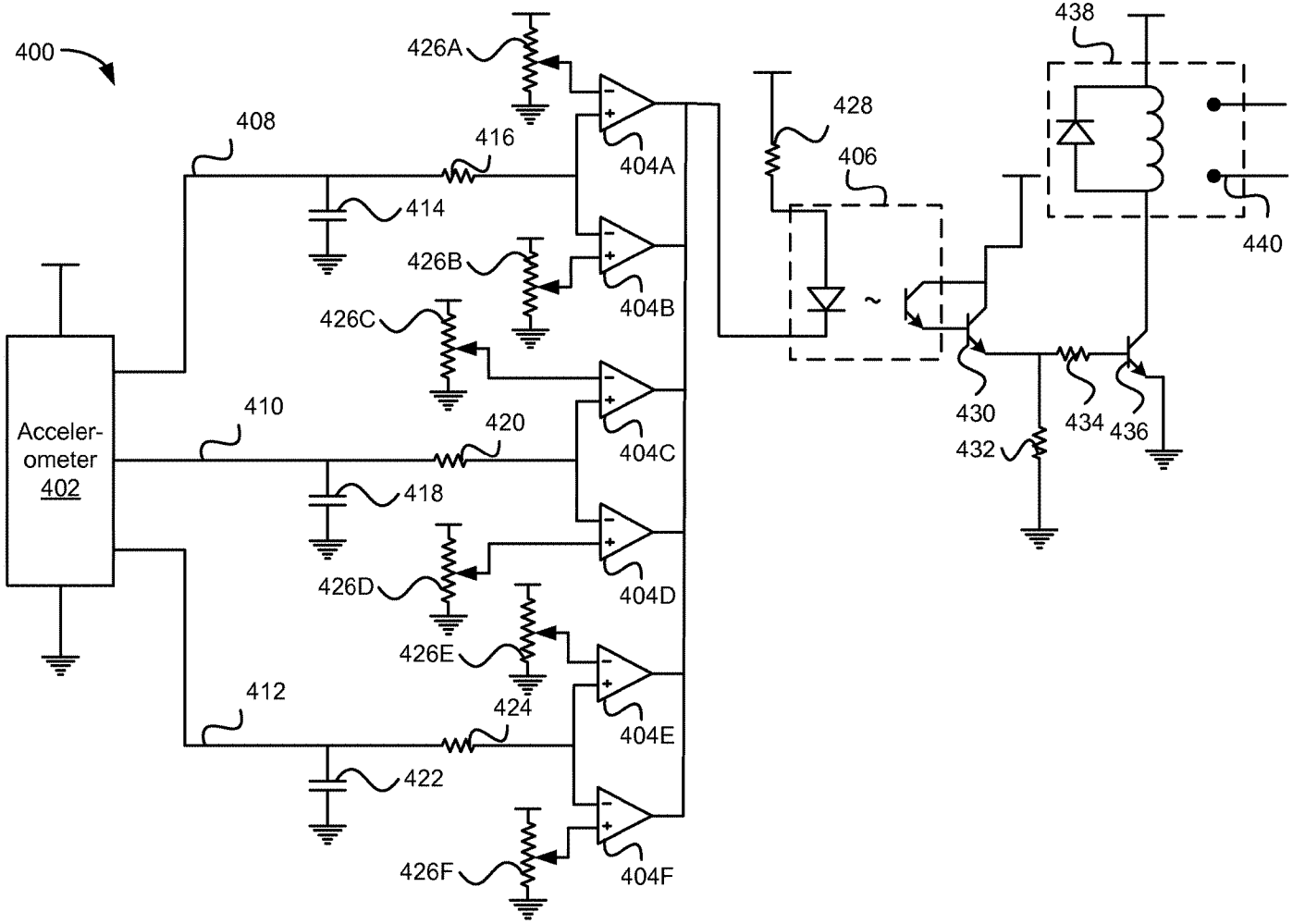
FIG. 4 is another safety device for a chainsaw without a microprocessor in some embodiments.

In various embodiments, the safety device 200 of FIG. 2 or the safety device 400 of FIG. 4 contain or are coupled to a power supply. In one example, the safety device 200 may be coupled to a battery or capacitor which provides power to the accelerometer 202 and the microprocessor 204. In some embodiments, the safety device 200 or the safety device 400 receives at least some power from a power supply such as a battery and other power from the power source of the chainsaw. Those skilled in the art will appreciate that the safety device 200 or the safety device 400 may be powered in any number of ways.

Although FIG. 2 depicts multiple signal paths 212, 214, and 216 for providing acceleration values, those skilled in the art will appreciate that there may be any number of signal paths to provide any number of acceleration values along any number of axes. In one example, a single path may be used by the accelerometer 202 to provide the acceleration value for the x axis and the acceleration value for the y axis (e.g., via muliplexing).

Although FIG. 2 shows three connections for to the accelerometer 202 for providing acceleration values in the x, y, and z axes, it will be appreciated by those skilled in the art that the accelerometer 202 may only provide acceleration values for any number of axes. In one example, the accelerometer 202 may provide only the acceleration value for the x axis (e.g., in the x axis of the chainsaw only).

Further, the magnetic breaker 250 may be replaced by any circuit that is configured to provide a signal associated with the signal (or the same signal) from the microprocessor 204 to interrupt the power of the chainsaw or the chainsaw blade. In various embodiments, the magnetic breaker 250 may be used to shut down the engine of the chainsaw, engage a chain brake, and/or disengage the clutch of the chainsaw.

In some embodiments, the accelerometer 202 is optional. In one example, the gyroscope 260 as shown in FIG. 2B may determine the pitch, roll, or yaw of the chainsaw 100. In this example, the microprocessor 204 may receive data from the gyroscope 260 regarding the pitch, roll, or yaw of the chainsaw 100, and, if the data from the gyroscope 260 is sufficiently greater than or sufficiently less than a predetermined threshold, the microprocessor may generate a signal to deactivate the chainsaw 100, or otherwise interrupt power to slow down the chainsaw blade or shut off the chainsaw as described herein.

Figure 3:
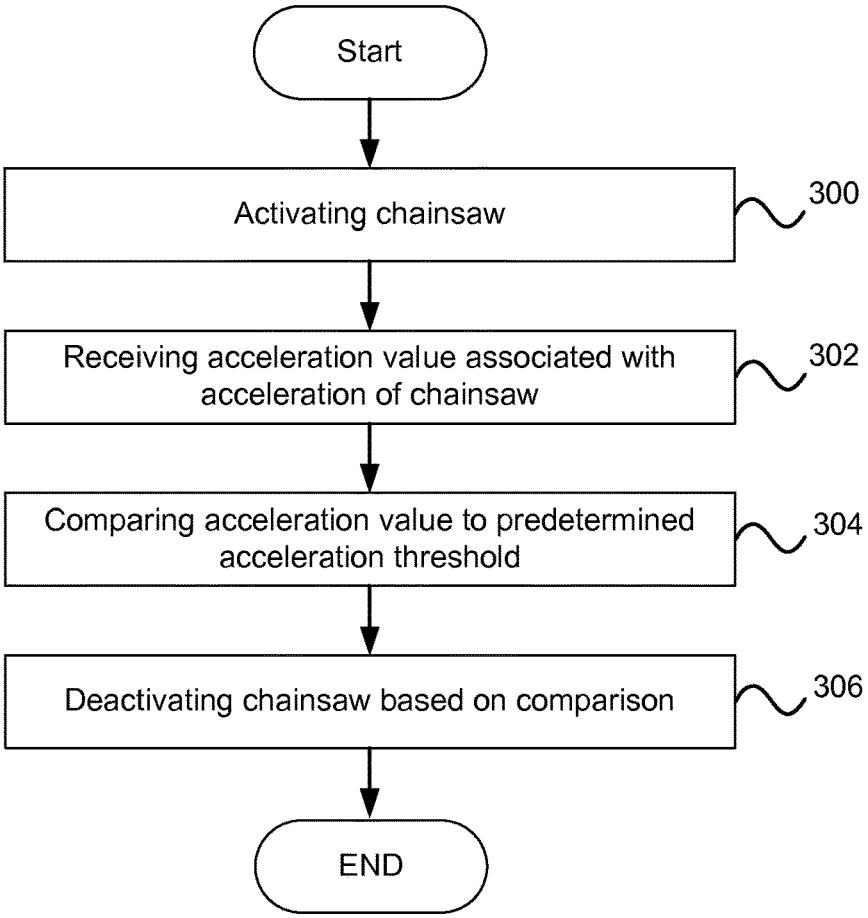
FIG. 3 is a flow diagram of an exemplary process for a safety device for a chainsaw in some embodiments.

FIG. 3 is a flow diagram of an exemplary process for a safety device 200 for a chainsaw in some embodiments. Typically, acceleration values associated with safe use of a chainsaw may be insufficient to cause the safety device 200 to interrupt the power to the chainsaw. However, once acceleration in one or more axes is detected for over a certain duration (e.g., by comparing acceleration values to a predetermined acceleration threshold over time), the safety device may deactivate the chainsaw or otherwise interrupt power to slow down the chainsaw blade or shut off the chainsaw.

Figure 1:
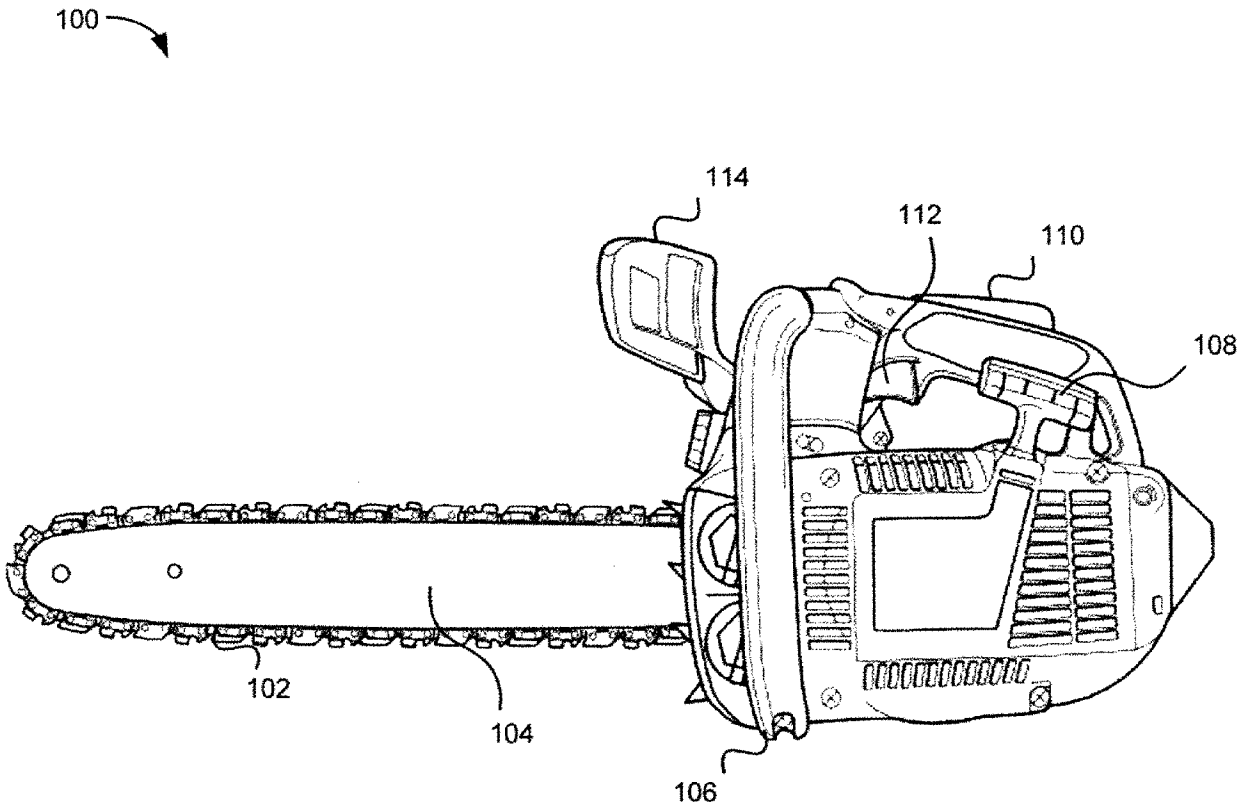
FIG. 1 (PRIOR ART)
FIG. 1 is a chainsaw in the prior art

In step 300, the chainsaw is activated. As discussed regarding FIG. 1, the chainsaw may be activated by pulling on the starter handle 108. Once active, the operator may depress the throttle trigger lockout 110 in order to depress the throttle trigger 112 which starts the chainsaw blade 102 to run around the guide bar 104.

In some embodiments, the RPM of the engine of the chainsaw 100 is detected by the microprocessor 204. In one example, input from the ignition coil is received via signal paths 226 and 228 by the optically coupled isolator 206 which provides pulses associated with the ignition coil to the microprocessor 204. The microprocessor 204 may calculate the RPM of the chainsaw based on the pulses. When the RPM (or an RPM level) of the chainsaw engine is detected, the microprocessor 204 may activate the safety features of the chainsaw 100.

In step 302, the safety device 100 receives an acceleration value associated with acceleration of the chainsaw 100. In one example, the accelerometer 202 detects the acceleration of the chainsaw 100 in the x axis and provides one or more acceleration values. The microprocessor 204 may receive the acceleration value(s) from the accelerometer 202.

In step 304, the safety device 100 compares the acceleration value at a duration of the acceleration associated with the acceleration value to a predetermined threshold to determine a risk condition. In one example, the microprocessor 204 compares one or more acceleration value(s) associated with one or more duration values from the accelerometer 202 to one or more predetermined thresholds to determine a risk condition. In another example, the microprocessor 204 determines the duration of multiple acceleration values in a given axis. If the duration of the multiple acceleration values exceeds a predetermined threshold, the microprocessor may compare one or more of the acceleration values in the given axis (or any statistical measure of the acceleration values (e.g., an average)) to a predetermined acceleration threshold.

In various embodiments, acceleration in different axes caused by the engine and normal movement of the chainsaw caused by everyday safe use by a chainsaw operator is taken into account as part of the predetermined acceleration threshold(s). As a result, everyday safe use of the chainsaw may not cause the microprocessor 204 to determine that a risk condition exists. For example, acceleration values for the x axis of a chainsaw in normal safe use may be generated by the accelerometer 202. In some embodiments, a low pass filter may filter acceleration values associated with short durations (e.g., the duration being set by the capacitance of the low pass filter). In other embodiments, the microprocessor 204 may remove any number of acceleration values that do not last a predetermined duration (e.g., by comparing a any duration calculated by the microprocessor to predetermined duration thresholds). The microprocessor 204 may compare those acceleration values that are for sufficient duration against one or more predetermined acceleration threshold(s). Since the acceleration values associated with safe use of the chainsaw typically do not exceed the predetermined acceleration threshold(s), the microprocessor 204 may not determine that a risk condition exists.

In step 306, the safety device 200 deactivates the chainsaw based on the comparison of the acceleration value and the predetermined acceleration threshold. For example, the microprocessor 204 may activate the kill switch to the chainsaw or generate a signal to interrupt the power to the chainsaw or the blade of the chainsaw. In some embodiments, the microprocessor 204 determines that the chainsaw is in a risk condition based on one or more acceleration value(s) received from the accelerometer 202. After comparing the acceleration value(s) for a duration to one or more predetermined acceleration thresholds, the microprocessor 204 may determine that acceleration of the chainsaw over the duration exceeds safe conditions and that a risk condition exists. In response, the microprocessor 204 may generate a risk signal to activate a kill switch, interrupt the power of the chainsaw or the chainsaw blade, or deactivate power.

FIG. 4 is another safety device 400 for a chainsaw without a microprocessor in some embodiments. Various components and/or circuits of the safety device 400 may receive power from the power source of the chainsaw and/or another power source such as a battery or capacitor.

In various embodiments the safety device comprises an accelerometer 402, a plurality of comparators 404A-F, optically coupled isolator 406, and a magnetic breaker 438. The accelerometer 402 may be similar to the accelerometer 202 depicted in FIG. 2A. In one example, the accelerometer 402 may be configured to generate one or more acceleration values associated with the chainsaw along one or more axes. In some embodiments, the accelerometer 402 is configured to provide an acceleration value for the x axis along signal path 408, an acceleration value for the y axis along signal path 410, and an acceleration value for the z axis along signal path 412. There may be any number of signal paths for providing any number of acceleration values.

The safety device 400 also comprises a low pass filter (e.g., an integrator) along each signal path. Signal path 408 includes a low pass filter comprising resistor 416 and capacitor 414 which is also coupled to ground. Signal path 410 includes a low pass filter comprising resistor 420 and capacitor 418 which is coupled to ground. Further, Signal path 412 includes a low pass filter comprising resistor 424 and capacitor 422 which is coupled to ground. The capacitors 414, 418, and 422 are filter capacitors that may be configured to determine a cut-off frequency f the low pass filter where:

$$f = \frac{1}{2\pi RC}$$

where R is the output resistance of the accelerometer (e.g., resistor 416) and C is the filter capacitance (e.g., capacitor 414).

In various embodiments, the capacitance of the low pass filter determines the cut off frequency (i.e., minimum time duration for the acceleration) to trigger the magnetic breaker 438 of the ignition of the chainsaw. The low pass filter may filter out noise such as engine vibrations. In one example, the low pass filter is configured to filter out acceleration of duration of less than 1 ms. In other examples, the low pass filter may be configured to filter out acceleration of duration of less than about 2 ms., less than about 3 ms., less than about 4 ms., less than about 5 ms., less than about 6 ms., less than about 7 ms., less than about 8 ms., less than about 9 ms., or less than about 10 ms. Those skilled in the art will appreciate that the low pass filter may be configured to filter out acceleration of any amount of duration.

Each acceleration value from the accelerometer 402 may be received by two comparators. For example, the acceleration value for the x axis along signal path 408 may be received by comparators 404A and 404B. The acceleration value for the y axis along signal path 410 may be received by comparators 404C and 404D. The acceleration value for the z axis along signal path 412 may be received by comparators 404E and 404F. Each comparator 404A-F is coupled to a potentiometer 426A-F, respectively. Each potentiometer may be adjusted to set the acceleration range for an axis window. In some embodiments, acceleration that exceeds this window will trigger the magnetic breaker 438.

In one example, the duration of the acceleration value for the x axis along signal path 408 exceeds a minimum duration and is not filtered out by the low pass filter. The acceleration value of the x axis is received by comparator 404A and 404B. Each comparator 404A and B compares the acceleration value to a predetermined threshold set by potentiometer 426A and B, respectively. If the acceleration value is beyond either predetermined threshold, the comparator 426A and/or B may generate a signal which is received by optically coupled isolator 406.

In another example, the duration of the acceleration value for the y axis along signal path 410 exceeds a minimum duration and is not filtered out by the low pass filter. The acceleration value of the y axis is received by comparator 404C and 404D. Each comparator 404C and D compares the acceleration value to a predetermined threshold set by potentiometer 426C and D, respectively. If the acceleration value exceeds either predetermined threshold, the comparator 426C and/or D may generate a signal which is received by optically coupled isolator 406.

In a further example, the duration of the acceleration value for the z axis along signal path 412 exceeds a minimum duration and is not filtered out by the low pass filter. The acceleration value of the z axis is received by comparator 404E and 404F. Each comparator 404E and F compares the acceleration value to a predetermined threshold set by potentiometer 426E and F, respectively. If the acceleration value exceeds either predetermined threshold, the comparator 426E and/or F may generate a signal which is received by optically coupled isolator 406.

Each comparator may be any kind, type, and model of comparator. In one example, each comparator 404A-F is a low power low offset voltage dual comparator (e.g., part number LM393). In some embodiments, all comparators of the safety device 400 are similar. In other embodiments, one or more comparators may be similar to or different than another comparator of the safety device 400.

The optically coupled isolator 406 is similar to the optically coupled isolator 208 and may comprise an LED coupled to resistor 428. The LED may emit light which is detected by a photodetector that is similar to the photodetector described in optically coupled isolator 208. The output of the photodetector of the optically coupled isolator 406 may be received by the base of the transistor 430. The emitter of transistor 430 may be coupled to resistor 432 which is further coupled to ground as well as resistor 434 which is further coupled to the base of transistor 436. The emitter of transistor 436 may be coupled to ground and the source may be coupled to the magnetic breaker 438 which may be similar to magnetic breaker 250 of FIG. 2. In some embodiments, the magnetic breaker 438 sends a risk signal via paths 440 to a kill switch of the chainsaw or to a device which interrupts the power to the chainsaw or the chainsaw blade. In various embodiments, the magnetic breaker 438 may be used to shut down the engine of the chainsaw, engage a chain brake, and/or disengage the clutch of the chainsaw.

Those skilled in the art will appreciate that the accelerometer 402 may provide an accelerometer 402 for only one axis or for any number of axes. Further, there may be only one signal path 408 or any number of signal paths. In some embodiments, the comparators 404A-F will activate when the acceleration values or a gravity value indicates that the chainsaw has been dropped.

In various embodiments of the safety device 400, the optically coupled isolator 406 and/or the magnetic breaker 438 are optional. In one example, the optically coupled isolator 406 may be replaced by any circuit that is configured to provide a signal associated with the signal (or the same signal) from the comparators 404A-E to interrupt the power of the chainsaw or the chainsaw blade. Similarly, the magnetic breaker 438 may be replaced by any circuit that is configured to provide a signal associated with the signal (or the same signal) from the comparators 404A-F to interrupt the power of the chainsaw or the chainsaw blade.

In some embodiments, the chainsaw 100 comprises two accelerometers. Two accelerometers can be used to measure the angular acceleration, for example. By using two or more accelerometers, the common noise (e.g., acceleration noises caused by engine) may be rejected and cleaner angular acceleration measurement(s) may be taken. The first accelerometer may be beside the second accelerometer. For example, the first accelerometer and the second accelerometer may be placed side-by-side along an axis that runs lengthwise down the chainsaw blade. In this example, the first accelerometer may be closer to the handle and the second accelerometer may be closer to the chainsaw blade. A kick back event may be detected when an acceleration detected by second accelerometer is greater than the acceleration detected by first accelerometer. For example, when an acceleration detected by second accelerometer is greater than the acceleration detected by first accelerometer, the blade of the chainsaw may be moving towards the operator indicating a kick back. If the acceleration reported by the second accelerometer is sufficiently greater than the acceleration reported by the first accelerometer (i.e., the difference is greater than a predetermined threshold), then the chainsaw blade may be deactivated as discussed herein. Further, a dangerous condition may also be detected if the acceleration reported by the second accelerometer is sufficiently less than the acceleration reported by the first accelerometer (i.e., the difference is less than a predetermined threshold). In these dangerous conditions, the chainsaw blade may also be deactivated as discussed herein.

In another example, when an acceleration reported by the first accelerometer is greater than an acceleration reported by the second accelerometer, the chainsaw blade may be moving towards the body or legs of the operator. If the acceleration reported by the first accelerometer is sufficiently greater than the acceleration reported by the second accelerometer (i.e., the difference is greater than a predetermined threshold), then the chainsaw blade may be deactivated as discussed herein. Further, a dangerous condition may also be detected if the acceleration reported by the first accelerometer is sufficiently less than the acceleration reported by the second accelerometer (i.e., the difference is less than a predetermined threshold). In these dangerous conditions, the chainsaw blade may also be deactivated as discussed herein.

It will be appreciated by those skilled in the art that there may be any number of accelerometers placed within or coupled to the chainsaw. Further, any of these accelerometers may be placed in any location within or coupled to the chainsaw (i.e., the location of each accelerometer is not limited to along an axis of the chainsaw and, further, the location of each accelerometer is not limited to being side-by-side). In various embodiments, any number of predetermined thresholds may be predetermined to detect dangerous conditions. Any number of dangerous conditions may be detected when the acceleration detected by one or more accelerometers compared to acceleration detected by one or more other accelerometers is greater than or less than the predetermined threshold(s).

Figure 5:
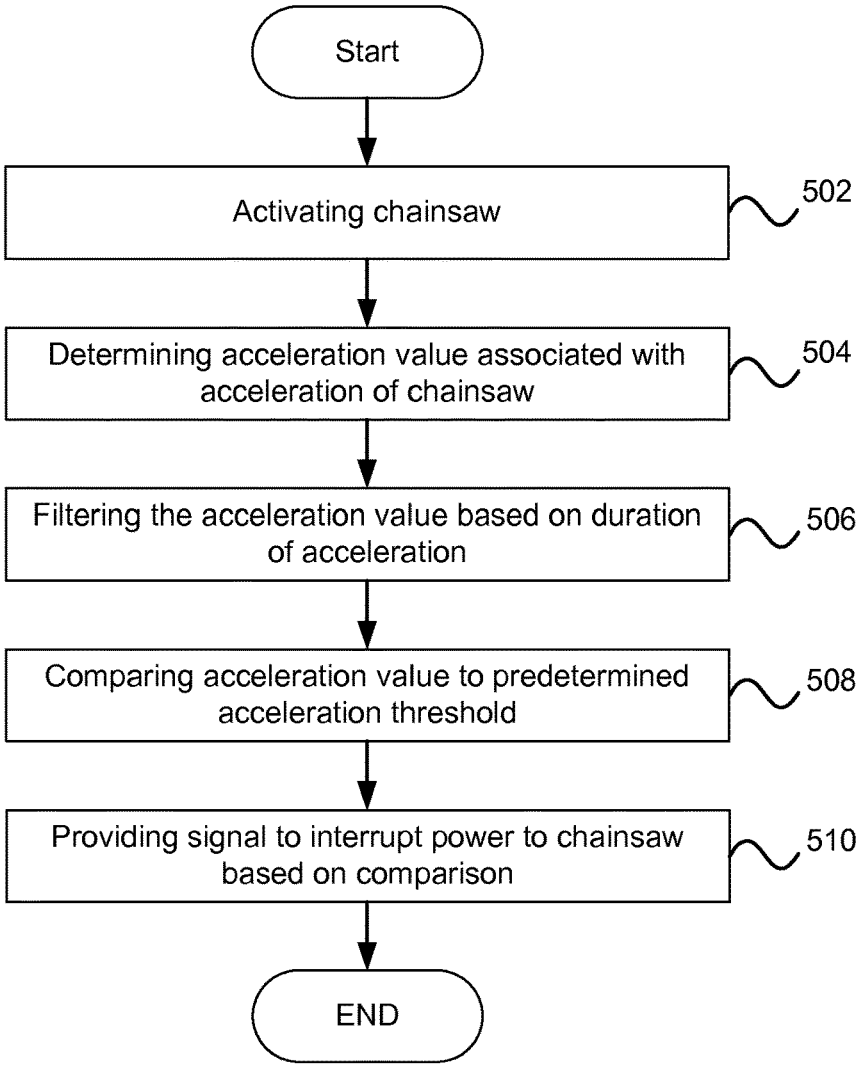
FIG. 5 is another flow diagram of an exemplary process for a safety device for a chainsaw in some embodiments.

FIG. 5 is another flow diagram of an exemplary process for a safety device 400 for a chainsaw in some embodiments. In step 502, a chainsaw is activated. In some embodiments the power to the chainsaw powers the safety device 400 or components of the safety device 400. In step 504, the safety device 400 determines an acceleration value associated with acceleration of a chainsaw. For example, the accelerometer 402 may detect acceleration of the chainsaw, determine an acceleration value associated with acceleration of the chainsaw, and provide the acceleration value over signal path 408.

In step 506, the safety device 400 filters the acceleration value based on duration of acceleration. In one example, a low pass filter filters the acceleration value based on duration of acceleration. If a duration of the acceleration value exceeds a predetermined acceleration threshold, the acceleration value may be further processed and/or analyzed (e.g., by comparators). In some embodiments, the predetermined duration threshold is based on filter capacitance of the low pass filter.

In step 508, the acceleration value is compared to a predetermined acceleration threshold. In some embodiments, two comparators receive the acceleration value. Each comparator compares the acceleration value to a different predetermined acceleration threshold (e.g., the acceleration value is compared against a predetermined acceleration window). Each predetermined acceleration threshold may be based on a potentiometer that may be modified during manufacture and/or by the chainsaw operator.

In step 510, the safety device 400 provides a signal to interrupt power to the chainsaw based on the comparison. In some embodiments, the output of one or more of the comparators is used to generate a risk signal to deactivate the chainsaw. The chainsaw may be deactivated by interrupting the power to the chainsaw or the chainsaw blade. In one example, the output from the comparators activates the optically coupled isolator 406 which causes the magnetic breaker 438 to provide a risk signal to the chainsaw (e.g., kill switch of the chainsaw or ignition coil).

In various embodiments, the safety device may comprise a means to detect acceleration, an accelerometer, a comparing module, and a means to interrupt power to the chainsaw. Although accelerometers are herein described, any means for determining acceleration of the chainsaw may be used. Similarly, the comparing module may comprise a microprocessor (one embodiment as described in FIG. 2 herein) or without a microprocessor (one embodiment as described in FIG. 4 herein). The embodiments described herein are not limiting; those skilled in the art will appreciate that there may be many ways, including by software, hardware, or a combination of both, for the comparing module to compare acceleration values from the accelerometer (or the means for determining acceleration of the chainsaw) to one or more predetermined acceleration thresholds.

Those skilled in the art will appreciate that any chainsaw may work with the safety device including, but not limited to, electric and gas chainsaws. In one example, the safety device may be used to control the engine ignition system for gasoline operated chainsaws and to cut off power for electric or cordless electric chainsaws. In some embodiments, the safety device may be coupled to a chainsaw during or after manufacture of the chainsaw. Similarly, the acceleration threshold and/or the duration threshold of the safety device may be modified during manufacture, and/or, in some embodiments, by the chainsaw operator. In one example, the duration threshold may be adjusted based on the type of work to be performed. As a result, workers of the timber industry may have different needs than the untrained chainsaw operator who operates a chainsaw for smaller projects. Similarly, the acceleration threshold may be adjusted during manufacture and/or by the chainsaw operator based on need.

One or more of the above-described functions can be comprised of instructions that are stored on a storage medium such as a computer readable medium. The instructions can be retrieved and executed by a processor. Some examples of instructions are software, program code, and firmware. Some examples of storage medium are memory devices, tape, disks, integrated circuits, and servers. The instructions are operational when executed by the processor to direct the processor to operate in accord with embodiments of the present invention. Those skilled in the art are familiar with instructions, processor(s), and storage medium. In one example, software (e.g., instructions that are executable by a processor) may be stored within the microprocessor 204 which contains computer readable medium configure to store the software. The software may be configured to perform any and all functions described herein including, but not limited to, configuration of the microprocessor 204 (e.g., setting the predetermined threshold).

The present invention is described above with reference to exemplary embodiments. It will be apparent to those skilled in the art that various modifications may be made and other embodiments can be used without departing from the broader scope of the present invention. Therefore, these and other variations upon the exemplary embodiments are intended to be covered by the present invention.

What is claimed is:

1. A system comprising:

at least one gyroscope unit configured to measure pitch, roll and yaw parameters of a chainsaw, the pitch, roll and yaw parameters representing angular motion of the chainsaw, the at least one gyroscope unit configured to generate one or more first output signals based on the measured pitch, roll and yaw parameters, the at least one gyroscope unit configured to provide the one or more first output signals to one or more first output terminals;

capacitive circuitry coupled to the one or more first output terminals, the capacitive circuitry configured to generate one or more second output signals when the at least one gyroscope unit has generated the one or more first output signals for longer than a threshold duration, the capacitive circuitry configured to provide the one or more second output signals to one or more second output terminals;

a comparison module coupled to the one or more second output terminals, the comparison module configured to compare the measured pitch, roll and yaw parameters to at least one threshold condition that defines the chainsaw kicking back or being dropped, and to generate a first chainsaw termination signal if the measured pitch, roll and yaw parameters satisfy the at least one threshold condition, the comparison module configured to provide the first chainsaw termination signal to a third output terminal;

a kill switch configured to interrupt operation of the chainsaw in response to a kill switch signal;

an optically coupled isolator coupled to the third output terminal, the optically coupled isolator configured to substantially electrically isolate the comparison module from the kill switch, the optically coupled isolator configured to receive the first chainsaw termination signal and to generate a second chainsaw termination signal in response to receiving the first chainsaw termination signal, the optically coupled isolator configured to provide the second chainsaw termination signal to a fourth output terminal; and a magnetic breaker coupled to the fourth output terminal and to the kill switch, the magnetic breaker configured to receive the second chainsaw termination signal and to generate the kill switch signal in response to receiving the second chainsaw termination signal, the magnetic breaker configured to provide the kill switch signal to the kill switch.

2. The system of claim 1, wherein the comparison module includes a microprocessor.

3. The system of claim 1, wherein the comparison module includes a first set of one or more comparators for evaluating the pitch parameter, a second set of one or more comparators for evaluating the roll parameter, and a third set of one or more comparators for evaluating the yaw parameter.

4. The system of claim 1, wherein the kill switch signal causes the chainsaw to interrupt power to the chainsaw.

5. The system of claim 1, wherein the kill switch signal causes the chainsaw to interrupt power to a chainsaw blade.

6. The system of claim 1, wherein the kill switch signal causes the chainsaw to engage a chain brake.

7. The system of claim 1, wherein the kill switch signal causes the chainsaw to disengage a clutch.

8. The system of claim 1, wherein the kill switch signal causes the chainsaw to shut down an engine.

9. A system comprising:

means for measuring pitch, roll and yaw parameters of a chainsaw, the pitch, roll and yaw parameters representing angular motion of the chainsaw means for generating one or more first output signals based on the measured pitch, roll and yaw parameters;

means for providing the one or more first output signals to one or more first output terminals;

means for generating one or more second output signals when the means for generating the one or more first output signals has generated the one or more first output signals for longer than a threshold duration;

means for providing the one or more second output signals to one or more second output terminals;

means for comparing the measured pitch, roll and yaw parameters to at least one threshold condition that defines the chainsaw kicking back or being dropped;

means for generating a first chainsaw termination signal if the measured pitch, roll and yaw parameters satisfy the at least one threshold condition;

means for providing the first chainsaw termination signal to a third output signal;

means for interrupting operation of the chainsaw in response to a kill switch signal;

means for substantially electrically isolating the means for comparing the pitch, roll and yaw parameters from the means for interrupting operation of the chainsaw;

means for receiving the first chainsaw termination signal;

means for generating a second chainsaw termination signal in response to receiving the first chainsaw termination signal;

means for providing the second chainsaw termination signal to a fourth output terminal;

means for receiving the second chainsaw termination signal;

means for generating the kill switch signal in response to receiving the second chainsaw termination signal; and means for providing the kill switch signal to the means for interrupting operation of the chainsaw.

* * * * *